US008733066B2

(12) United States Patent
Carlson

(10) Patent No.: US 8,733,066 B2
(45) Date of Patent: May 27, 2014

(54) POLYURETHANE-POLYUREA COATED DOOR FOR WALK-IN COOLERS AND FREEZERS

(71) Applicant: Eric Alan Carlson, Kingwood, TX (US)

(72) Inventor: Eric Alan Carlson, Kingwood, TX (US)

( * ) Notice: Subject to any disclaimer, the term of this patent is extended or adjusted under 35 U.S.C. 154(b) by 0 days.

(21) Appl. No.: 13/727,669

(22) Filed: Dec. 27, 2012

(65) Prior Publication Data

US 2013/0167474 A1 Jul. 4, 2013

Related U.S. Application Data

(60) Provisional application No. 61/581,491, filed on Dec. 29, 2011.

(51) Int. Cl.
*E04C 2/54* (2006.01)

(52) U.S. Cl.
USPC ..... 52/784.15; 52/456; 52/309.7; 52/309.9; 52/309.14

(58) Field of Classification Search
USPC ..... 52/784.1, 784.15, 784.16, 455, 456, 52/309.4, 309.7, 309.9, 309.14, 309.16
See application file for complete search history.

(56) References Cited

U.S. PATENT DOCUMENTS

| | | | | |
|---|---|---|---|---|
| 2,726,424 | A | 12/1955 | Lingle | |
| 3,985,175 | A * | 10/1976 | Pukl | 160/229.1 |
| 7,752,822 | B2 | 7/2010 | Minelli | |
| 7,937,895 | B2 * | 5/2011 | Janka et al. | 52/79.1 |
| 2001/0039768 | A1 * | 11/2001 | Bigelow | 52/79.1 |
| 2002/0189182 | A1 * | 12/2002 | Record | 52/309.9 |
| 2004/0226253 | A1 * | 11/2004 | Yates et al. | 52/717.01 |
| 2005/0206286 | A1 * | 9/2005 | Finkelstein | 312/401 |
| 2006/0080920 | A1 | 4/2006 | Barr | |
| 2006/0248833 | A1 * | 11/2006 | Autovino et al. | 52/455 |
| 2010/0212258 | A1 * | 8/2010 | Wysock et al. | 52/784.1 |

OTHER PUBLICATIONS www.vortexdoors.com.

* cited by examiner

*Primary Examiner* — Brian Glessner
*Assistant Examiner* — Brian D Mattei
(74) *Attorney, Agent, or Firm* — Ferrell's PLLC; M. Susan Spiering

(57) ABSTRACT

Described herein is a custom built-to-size, polyurethane-polyurea coated door for walk-in coolers and freezers, which will withstand collision, and wear-and-tear in an industrial or commercial setting.

5 Claims, 4 Drawing Sheets

POLYURETHANE-POLYUREA COATED DOOR FOR WALK-IN COOLERS AND FREEZERS

CROSS REFERENCE TO RELATED APPLICATIONS

This application claims priority to U.S. Provisional Application Ser. No. 61/581,491, tilted: "Polyurethane-Polyurea Coated Door for Walk-in Coolers and Freezers" filed on Dec. 29, 2011, entire contents of which are herein incorporated by reference.

BACKGROUND

1. Field of the Invention

The present invention is directed towards walk-in cooler/freezer cold doors and more particularly towards insulated doors to be used in refrigerated, freezer, or warmer walk-in units wherein the temperature is different inside and outside the unit, and utilized by personnel walking or carrying items into and out of the unit using lifting and transporting equipment.

2. Description of the Related Art

Coolers are widely used. A myriad of applications calls for maintaining temperatures at a reduced level. Some examples include food processing plants, dairies, bakeries, bottling plants, restaurants, supermarkets, hospitals, and school cafeterias. In the medical setting, coolers are used to maintain the temperature of test samples and medications. In the restaurant business, coolers are used to keep food items, beverages etc. at a certain temperatures. The refrigerated compartment of such coolers may be kept below 32° F. Hence, coolers are often referred to as refrigerators or freezers. In commercial settings, coolers are often large enough for a person to walk into. The contents of the cooler are frequently accessed; hence the doors of the coolers are opened frequently. With large commercial units, the access often includes use of dollies and heavy duty equipment such as fork-lifts to hold pallets of items. Every time the cooler door is opened it can lead to collisions between the door and the person entering with equipment such as pallets jacks, forklifts, and the like, causing damage to the door.

Walk-in cooler or freezer door manufacturers generally use 4" rigid foamed in-place non-CFC urethane foam insulation inside the doors, which is then enclosed with 26 gauge white stucco embossed galvanized steel shell. U.S. Pat. No. 2,726,424 describes an example of this type of door. The cooler, or freezer door provides access to the cooler or freezer box and workers utilize hand carts, pallet jacks and forklifts, for the purposes of loading and unloading goods and merchandise. Collisions with the door are common and result in dents bending, and structural damage on the door. Occasionally, a 3/16" aluminum diamond plate is installed to the lower section of the door, to absorb these impacts in an attempt to prevent the door from cave-in. However, over time, the damage sustained to the door from these impacts still requires repair or replacement of the door. This shortened lifespan of the door becomes a costly expense for the customer.

A problem with the present cooler door construction on commercial coolers or freezers is that walk-in doors for these coolers and freezers on the market, though properly constructed, are often not fabricated to withstand adverse conditions such as, severe impacts from pallet jacks or fork lifts, condensation, infiltration or resulting corrosion. The impacts described above eventually break the outer skin of the shell, often made of steel, apart from the insulation, causing the door to lose its form and shape. Once the door is damaged and or deformed, it is no longer capable of keeping a tight fit that is desired and necessary to keep the cold air in and warm air out of the cooler. The effect of this being loss of large amounts of refrigeration energy and the collection of condensation on and inside the door and box. A subsequent problem with the damaged door is loss or damage of product stored in the cooler. Customers lose inventory due to product shrinkage because the cold box is no longer capable of keeping the temperature needed to properly store produce and other perishable goods or products. The presence of condensation on or around the door also leads to ice accumulation in the cold box, which causes further damage and also leaves the box susceptible to mold and contamination. Lastly, contact with exposed, protruding metal from the damaged and/or deformed door can cause serious injury to workers. Accordingly, there remains a need in the industry for a door to a cold box capable of withstanding the rigors of commercial use, having durability, and allowing for energy conservation, as well as maintaining a suitable lifespan.

SUMMARY

As used herein, cold box, cooler, refrigeration or freezer box, or ice box are used interchangeably. The invention can also be utilized for hot boxes or units wherein the temperature inside the box is different than that outside, and entry is required into the box by personnel having to cart boxes, or utilize dollies, pallet jack forklifts, or similar type of transporting equipment, goods, or products into the box.

The present invention is an improvement on the existing standard of walk-in doors for commercial coolers and freezers. It houses 4" rigid foamed in-place, non-CFC urethane foam insulation in the encapsulation of the door. The inventive door consists of a solid wood frame surrounding the insulation which is then sandwiched between two plywood, or similar, panels. For additional protection of the door, the assembly is entirely sealed with a combination of polyurethane and polyurea blend coating. The result is an enclosed, airtight, waterproof, corrosion resistant, thermal-barred door that will not warp or lose shape and is capable of withstanding adverse conditions under which it is frequently placed in industrial uses. This also provides protection against the collection of condensation on and inside the door and against other contaminants that otherwise deform the door and prevent the tight fit that is desired and necessary to keep cold air in and warm air out, or vice versa. The door of the present invention is tough, rigid, durable, generally airtight, waterproof, resilient, and sturdy enough to withstand impacts experienced in commercial use, and particularly those having at least a force of about 5 lbs or more. The life expectancy of this door is approximately 10-15 years and exceeds the 2-5 year lifespan of cold doors currently in use.

Details, including with respect to FIGS. 1-3B, are further described hereinafter.

BRIEF DESCRIPTION OF DRAWINGS

The invention is described in detail with reference to the drawings wherein like numbers designate similar parts and wherein.

DETAILED DESCRIPTION OF EMBODIMENTS

It has been found that doors for refrigeration cooler/freezer walk-in units on the market today are not designed to withstand frequent impact by users without damage. Swing type cooler/freezer walk-in doors used in commercial units are especially vulnerable to damage as they are frequently accessed by personnel carrying boxes or employing lifting devices. Generally, it has been found that while the door may withstand some impact, the external sheet metal and internal insulation will not. Barriers between front and back of grocery store style doors for walk-in units have some impact resistance, but typically not sufficient for protecting the insulation within the door. Hence, it is the object of this invention to have a door with a suitable frame and outer coating to withstand typical impacts found in commercial use of cold boxes, and still protecting the insulation found within the door structure.

It was further found that one could not just change the sheet metal and insulation found on the door structure to design around the current problem, but had to change the infrastructure of the door. For example, the inner frame, the insulation, and the outer layer of the insulation needed to be modified from the current structure to achieve the current invention. It was found that blocks for the hinges were needed to provide sufficient strength to bolt the hinges to the door. The wood panels on each side of the door enhanced its durability; the coating on the exterior maintained the airtight, waterproof, corrosion resistant, and thermal-door properties.

The following describes the door of the present invention, and it is understood that these components can be placed in, and sized to, any size dimension to fit any width and height openings in the cold box desired. The components for the frame can be made of wood or other suitable materials such as steel, or angle iron. The following dimensions provided are for illustrative purposes only.

Figure 1:
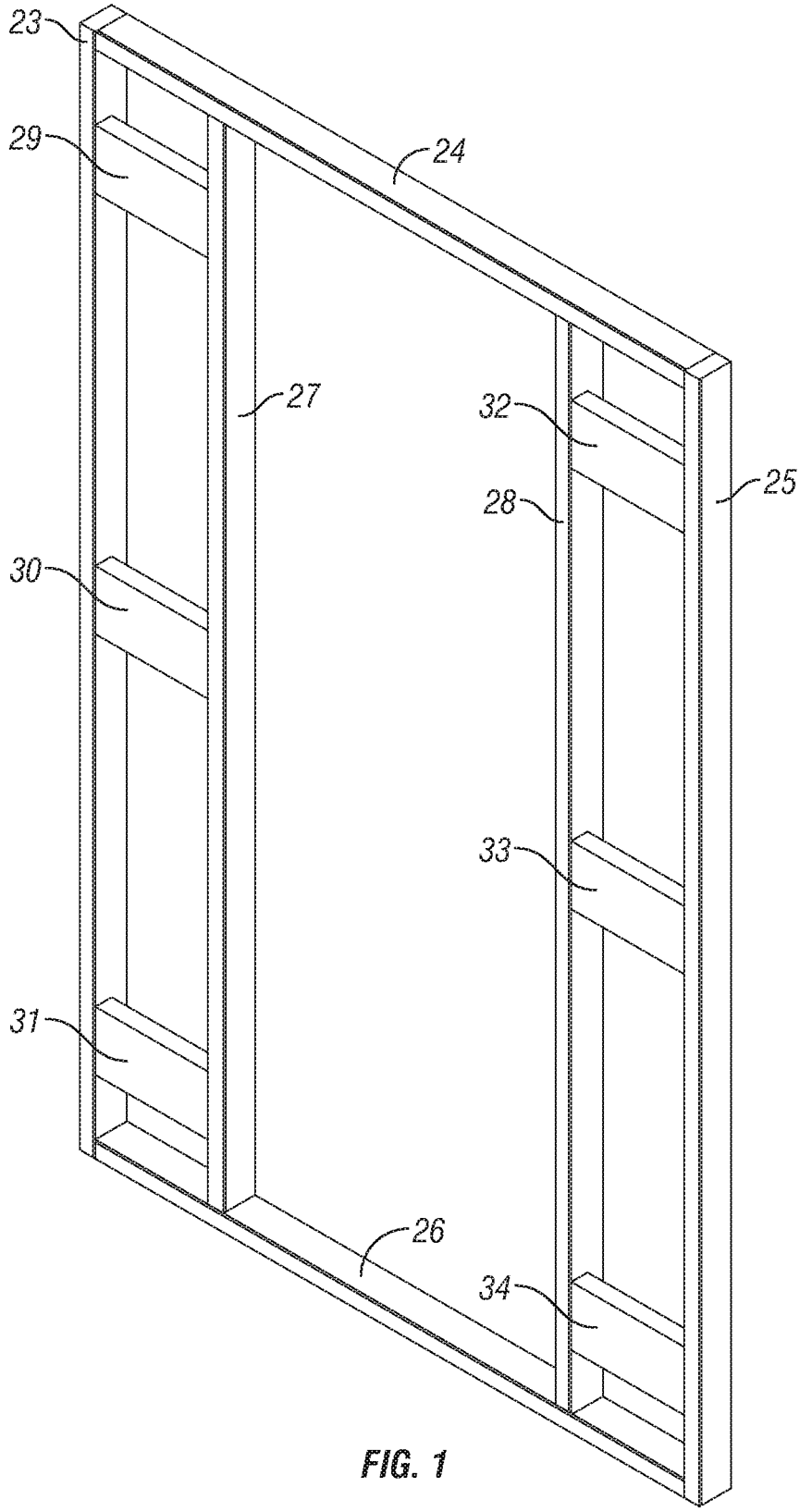
FIG. 1 illustrates a view of the frame inside the door.

FIG. 1 describes an isometric view of the frame inside the door. The frame consists of a top plank 24, a bottom plank 26, and two side outer legs 23 and 25. There are also two inner legs 27 and 28, which are positioned vertically between the top plank 24 and bottom plank 26. By means of this illustration for standard commercial cooler use, the components of the frame are constructed with 1½"×3" lumber. The first set of three hinge support beams 29, 30 and 31 are inserted horizontally and are attached between the left outer side leg 23 and the left inner side leg 27. The second set of three hinge support beams 32, 33, and 34 are inserted horizontally and are attached between the right outer side leg 25 and the right inner side leg 28. The frame is held together in the customary manner typically using screws, dowels, and glue at the interconnection points.

Figure 2:
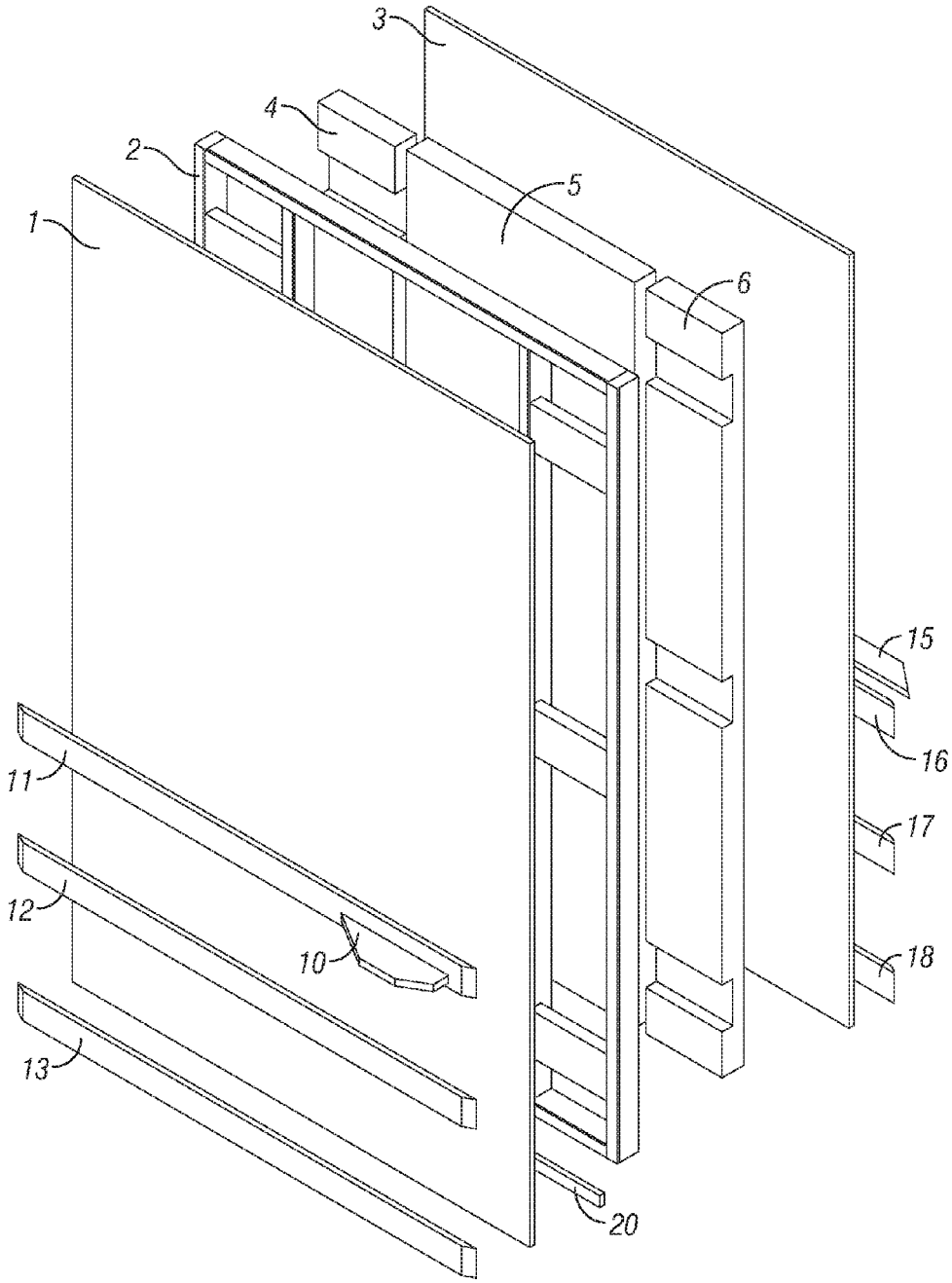
FIG. 2 illustrates a view of the door assembly.

FIG. 2 describes an isometric view of the assembly of the walk-in cooler/freezer door of the present invention, parts being broken away in section to reveal details of construction. The door structure is comprised of a front elongated rectangle (typically) ¾" thick plywood panel, or a composite material of varying thickness 1 (of an area greater than the door opening), a back elongated rectangle (typically) ¾" thick plywood panel, or a composite material of varying thickness 3 (of an area less than the door opening), an internal frame housing 2 (of an area less than the door opening) and other external parts as noted herein. After the door is assembled, it is sprayed with a compound blend of Polyurethane and Polyurea having the chemical composition described further herein. Inserted inside the door is a minimal 3" to maximize 8" thickness, Class 1 (Standard Specification ASTM C1289-11 for Faced Rigid Cellular Polyisocyanurate Thermal Insulation Board), rigid foam urethane insulation with a minimum density of about 2 pounds per cubic foot and not less than 97% closed cell structure to achieve maximum R value. The insulation material carries: a)—R value (material resistance to heat) of about 29.0, b)—K factor (thermal conductivity) of about 0.139 and c)—U factor (co-efficient of heat transfer) of about 0.035. The insulation is separated into three sections. The side sections of insulation 4 and 6 lay against the back panel 3 and are notched to slot into the open gaps between the hinge support beams 29-34. The center section of insulation 5 fits into the large opening of the frame 2 (between inner legs 27 and 28) and the entire assembly is sandwiched between the front 1 and back panel 3. The front panel 1, frame 2 and back panel 3 are secured together, typically screwed together using 2½" coarse wood screws, all of which are inserted along the perimeter of the frame. Next, six ¾"×3" (at the length based on the width of the inner and outer panels) wood strips used as bumper guards 11-13, 16-18 are attached on the outside face of the front and back panels, on the bottom area; three are mounted on the front panel 1 and three are mounted on the back panel 3. On the outside of the front panel 1, the top bumper guard 11 is mounted 35½" from the bottom, the middle bumper guard 12 is mounted 17¾" from the bottom and the bottom bumper guard 13 is mounted flush with the bottom of the door. All three bumper guards are attached to the front panel 1, using 2" coarse wood screws. On the outside of the back panel 3, the bumper guard 16 is mounted 37" from the bottom, the middle bumper guard 17 is mounted 19½" from the bottom and the bottom bumper guard 18 is mounted flush to the bottom of the door. All three bumper guards are attached to the back panel 3 using 2" coarse wood screws. The latch protector 10 is attached above the top bumper guard 11 on the front panel 1, along its inner edge. An inside release protector 15 is also attached above the top bumper guard 16, but on the back panel 3, along its inner edge. Typically the location of the bumper guard is the same on any size door. Lastly, a 1½"×½" wood strip 20 (used for the bottom sweep gasket 19 shown in FIG. 3B) is attached to the bottom edge of the inside of the front panel 1 of the door. The strip 20 is mounted to the door at the length based on the width of the inner panels, using 1" coarse wood screws.

Figure 3A:
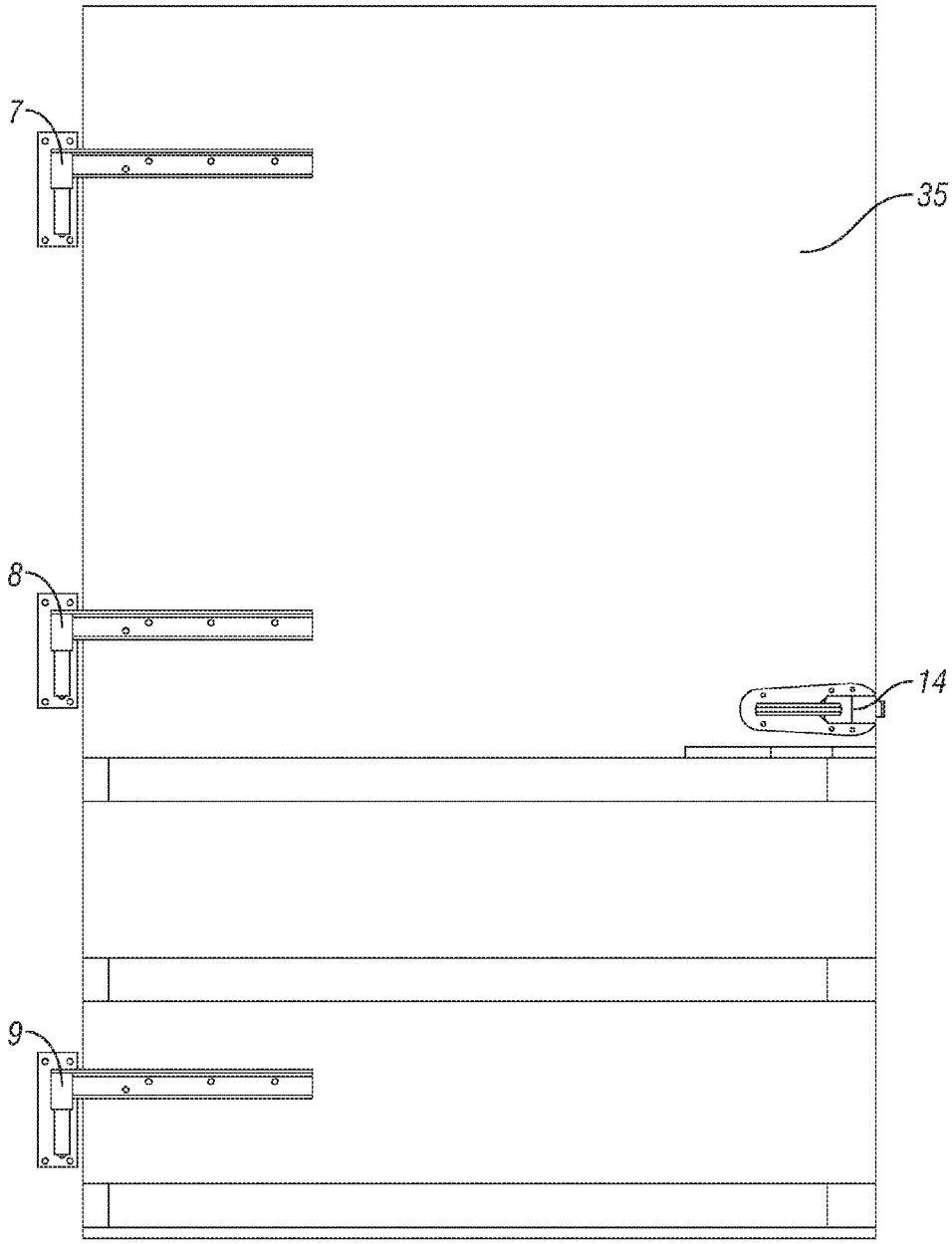
FIGS. 3A and 3B illustrate front and back sectional views of the door assembly with hardware attached.
Figure 3B:
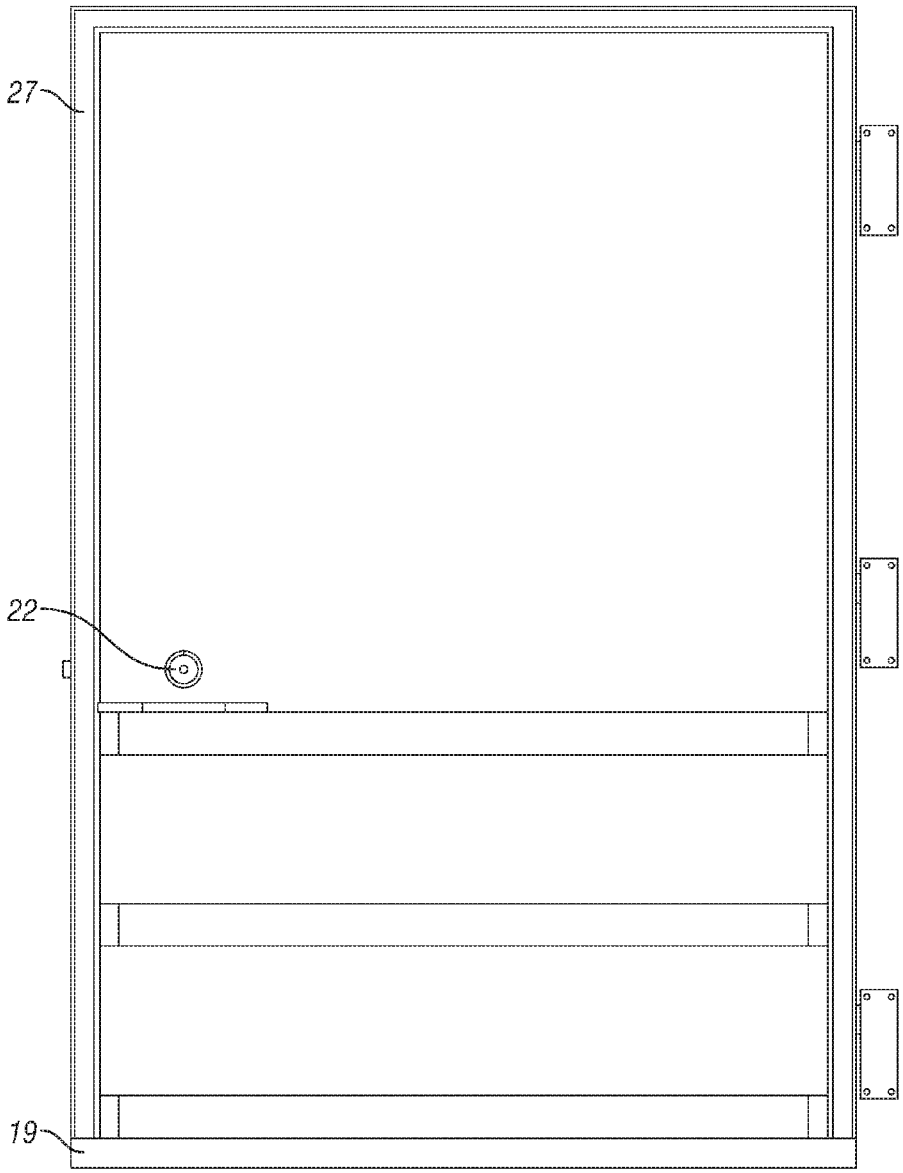

FIGS. 3A & 3B describes a front and back view of coated door assembly with hardware. Once the door structure is assembled, all holes and cracks are plugged with standard wood putty or the like, and left for a sufficient time to dry. Once dry, the entire door is pre-sanded and finished, with for example a belt-driven sander using 60-grade sandpaper and then finish sanded with a vibrating sander using 80-grade sandpaper so as to smooth all exterior surfaces. When the sanding process is complete, the door is wiped down sufficiently in preparation for the spray application of the polyurethane/polyurea blend compound 35. The first coat of the polyurethane/polyurea blend compound is sprayed from a distance of about 1", leaving about a ⅛" thick coat. After this first layer is dried, a second ⅛" thick layer of coating is spray-applied from about a 3" distance to the bottom half of the outside of the front 1 and back panel 3, totaling about a ¼" thick coat for these areas. The door is then left to allow the polyurethane mixture to cure for a sufficient period of time, typically for twenty-four hours, but timing will vary based on numerous conditions known in the art, such as thickness of the coating, humidity, heat, etc. Once the curing process is complete, three block hinges 7, 8, and 9 are screwed, using at least 2" lag bolts, throughout the outer edge of the front panel 1 and onto the support beams inside. Other hardware added to the door are the chrome plated, die-cast metal latch 14, mounted to the front panel 1, above the latch protector 10 and the inside release assembly 22, mounted to the back panel 3, above the inside release protector 15. A chrome plated rod, which is part of the inside release assembly 22, extends through the door and into the latch 14. Lastly, a rubber blade sweep gasket 19 is attached to the wood strip 20 on the bottom edge of the door and a compression gasket is secured to the residual outer perimeter of the top and sides of the door to form an air-tight seal. The compression gasket is resistant to water, oil and sunlight and is also easy to replace. With the door completed, it is mounted to the door opening of the cooler or freezer box, providing protection from impacts and completing the rigid structure.

Standard shock test experiments were conducted to test the doors' resilience to impact. During the laboratory test, a large weight is suspended above the shock table on which the door rests. Here, 2 tests were conducted wherein a 5'×8' door was exposed to direct (straight-on) impact by a 5 pound sledgehammer. The door was built as described herein but varying the coating.

| Test | coating | result/comments |
|---|---|---|
| 1 | ¼" | withstood compression and dents |
| 2 | 0 | deep compressions and dents formed immediately |

Accelerated aging studies on the coating found that a ¼" coating on said door withstood resistance to corrosion.

The sprayed-on coating applied is developed by Vortex Sprayliners, Incorporated and is comprised of a Polyurethane/Polyurea blended base component with a low viscosity, non-temperature sensitive isocyanate catalyst formulation available online at www.vortexsprayliners. It is comprised of: a) polyurea formed from a reaction mixture comprising isocyanate and amine wherein the ratio of equivalents of isocyanate groups to equivalents of amine groups is greater than 1 and the isocyanate and the amine can be applied to a substrate at a volume mixing ratio of 1:1; and b) polyurethane. The coating composition carries a Shore D hardness of 55+ (ASTM-D2240) and a tensile strength of 3,025+PSI (ASTM D638-94b). It also has a tear resistance factor of 475 PLI (ASTM D624). The abrasion resistance (Taber test/grams removed) is >0.075-250 cycles, >0.075-500 cycles, and >0.14-1000 cycles (ASTM C501). The impact resistance by feet to pounds is 4.5 (ASTM D256) and at −40 degrees Fahrenheit is 0.4 (ASTM D256). The coating material is also nonflammable, free of Chlorofluorocarbon (CFC) and meets USDA and FDA standards for incidental food contact. All the herein features do not change when applied on the door.

The inventive door has been found to be durable, airtight, waterproof, and resilient to impacts found under commercial applications. These doors provide an energy efficient thermal barrier for coolers and freezers, and long lasting protection from impacts, corrosion, and adverse conditions caused by normal commercial use. Overall benefits of the inventive door further include energy conservation, reducing shrinkage of goods/products stored within the cooler; fewer health violations when food is stored within the cooler, and lower maintenance of the cooler and related equipment (e.g., refrigeration compressors, fan motors, and other components used to maintain the cooler).

It should be understood that the present invention as described is an illustration, and various alternatives and modifications can be achieved by those of skill in the art without departing from the invention. Accordingly, the present invention is intended to embrace all such alternatives, modifications and variances. The preferred embodiments described with reference to the attached drawings are presented to demonstrate certain examples. Other elements, steps, methods and techniques that are insubstantially different from those described herein are also intended to be within the scope of the invention.

What is claimed is:

1. A walk-in cooler door assembly comprising a. an outer frame having a top plank, a bottom plank, and two outer legs, b. at least two inner legs secured vertically within the top and bottom planks, c. at least two beams, wherein the at least two beams horizontally connects said inner and outer legs, and wherein the at least two inner legs for providing structural strength to the walk-in cooler door, d. a front and back panel of composite material adhered to the outer frame, e. insulation material of at least 3 inches in thickness between the front and back panel, and a seamless polyurethane-polyurea coating of at least about ¼" applied to the outer surface of each panel, covering the entire assembly, capable of uniformly dispersing an impact and preventing denting of the walk-in cooler door assembly, wherein the door assembly is capable of withstanding standard shock test of at least 5 pounds of direct impact without forming a dent on the door.

2. The door assembly of claim 1 wherein the panels are made of at least ¾" plywood.

3. The door assembly of claim 2 wherein at least three beams are present on each side of the door assembly connecting the said inner and outer legs.

4. The door assembly of claim 1 wherein a thickness of the insulation material is between about 3 inches and about 8 inches.

5. The door assembly of claim 1 further comprising at least one bumper guard on the lower section of at least one of the front and back panels.

* * * * *